US008244156B2

(12) United States Patent
Iwamoto et al.

(10) Patent No.: US 8,244,156 B2
(45) Date of Patent: Aug. 14, 2012

(54) METHOD FOR PRODUCING CLEANING DEVICE AND CLEANING DEVICE

(75) Inventors: Kazunori Iwamoto, Kanagawa (JP); Naoki Koike, Kanagawa (JP); Yusuke Inoue, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 676 days.

(21) Appl. No.: 12/337,174

(22) Filed: Dec. 17, 2008

(65) Prior Publication Data

US 2009/0317124 A1 Dec. 24, 2009

(30) Foreign Application Priority Data

Jun. 20, 2008 (JP) ..... P2008-161453

(51) Int. Cl.
*G03G 15/20* (2006.01)

(52) U.S. Cl. ..... 399/123; 399/35; 399/351

(58) Field of Classification Search ..... 399/35, 399/105, 123, 264, 351
See application file for complete search history.

(56) References Cited

U.S. PATENT DOCUMENTS

2003/0059227 A1* 3/2003 Korfhage et al. ..... 399/102

FOREIGN PATENT DOCUMENTS

| | | |
|---|---|---|
| JP | 4-009869 | 1/1992 |
| JP | 04-289869 | 10/1992 |
| JP | 2004-101669 | 4/2004 |
| JP | 2005-043536 | 2/2005 |
| JP | 2005-043539 | 2/2005 |
| JP | 2006-296042 | 10/2006 |

* cited by examiner

*Primary Examiner* — Walter L Lindsay, Jr.
*Assistant Examiner* — Barnabas Fekete
(74) *Attorney, Agent, or Firm* — Morgan, Lewis & Bockius LLP

(57) ABSTRACT

A method for manufacturing a cleaning device of the image forming apparatus, the method includes: applying a liquid material to an area outside of an edge located at an end portion of a toner accommodating portion in the longitudinal direction of a toner removing member, wherein the liquid material is applied so as to seal the toner accommodating portion.

6 Claims, 9 Drawing Sheets

METHOD FOR PRODUCING CLEANING DEVICE AND CLEANING DEVICE

CROSS-REFERENCE TO RELATED APPLICATIONS

This application is based on and claims priority under 35 U.S.C. 119 from Japanese Patent Application No. 2008-257329 filed Jun. 20, 2008.

BACKGROUND

1. Technical Field

This invention relates to a method for producing a cleaning device when members relative to removal of developer are mounted in a housing through a liquid material and the cleaning device using the method.

2. Related Art

Previously known are image forming apparatuses in which an image is formed on a recording medium by transferring and fixing an developed image formed on the surface of an image carrier holding the developed image of toner. Some of these image forming apparatus are provided with a cleaning device in which unnecessary things such as residual toner left on the surface of an image holder after the developed image has been transferred onto the recording medium are cleaned by bringing the tip of a blade into contact with the surface of the image holder.

As described above, some cleaning devices for cleaning unnecessary things recover the unnecessary things scraped off by the blade into a box and also secure the blade at a position of a box.

Some of these cleaning devices cover a square opening connected to the inside of the box with a square blade and press the remaining opening region onto the image holder so that the unnecessary things scraped off by the tip of the blade, which is a part of the peripheral edge of the remaining opening region, is guided into the box through the remaining opening region.

Further, in the image forming apparatus provided with such a cleaning device, in order to prevent leakage of unnecessary things from the gap between the blade and box, a solid elastic sealing material serving as a blocking material is inserted in the gap.

However, there is a problem that it takes time to cut the solid elastic sealing material according to the shape of the overlapping area of the peripheral edge of the square opening and the square blade and affix the solid elastic sealing material thus cut to the peripheral edge of the opening.

SUMMARY

According to an aspect of the present invention, a method for producing a cleaning device of the image forming apparatus, the cleaning device including: a toner image carrier that has a surface moving in the predetermined direction and holding a toner image; a toner removing member that is in contact with the surface of the toner image carrier along a crossing direction that crosses a moving direction of the surface of the toner image carrier, the toner removing member removing a toner that remains on the surface of the toner image carrier after toner image is transferred; a supporting member that supports the toner removing member; a sliding member that is arranged at a location being an upstream side of the toner removing member in the moving direction of the surface of the toner image carrier, and is in contact with the surface of the toner image carrier; a housing that includes a toner accommodating portion that accommodates the toner removed by the toner removing member, the housing being attached to the toner removing member and the supporting member through a solidified material that is a liquid material when applied to the housing; and a sealing member that is arranged at a location being an upstream side of the sliding member in the moving direction of the surface of the toner image carrier, and seals a space between the toner image carrier and the housing, the method includes applying the liquid material to an area outside of an edge located at an end portion of the toner accommodating portion in the longitudinal direction of the toner removing member, wherein the liquid material is applied so as to satisfy one of the following conditions (1) to (3):

(1) applied amount of the liquid material for a closest approach distance between the housing and the toner removing member or the supporting member is larger in an area opposite to a step portion between the toner removing member and the supporting member than an area where the supporting member and the housing are opposite to each other;

(2) applied amount of the liquid material for a closest approach distance between the housing and the toner removing member or the supporting member is larger In an area opposite to a boundary between the toner removing member and the sliding member than an area where the supporting member and the housing are opposite to each other; and (3) applied amount of the liquid material for a closest approach distance between the housing and the toner removing member or the supporting member is larger in an area opposite to a boundary between the sliding member and the sealing member than an area where the supporting member and the housing are opposite to each other.

BRIEF DESCRIPTION OF THE DRAWINGS

Exemplary embodiment of the present invention will be described in detail based on the following figures, wherein.

DETAILED DESCRIPTION

The mode for carrying out this invention will be described below.

Figure 1:
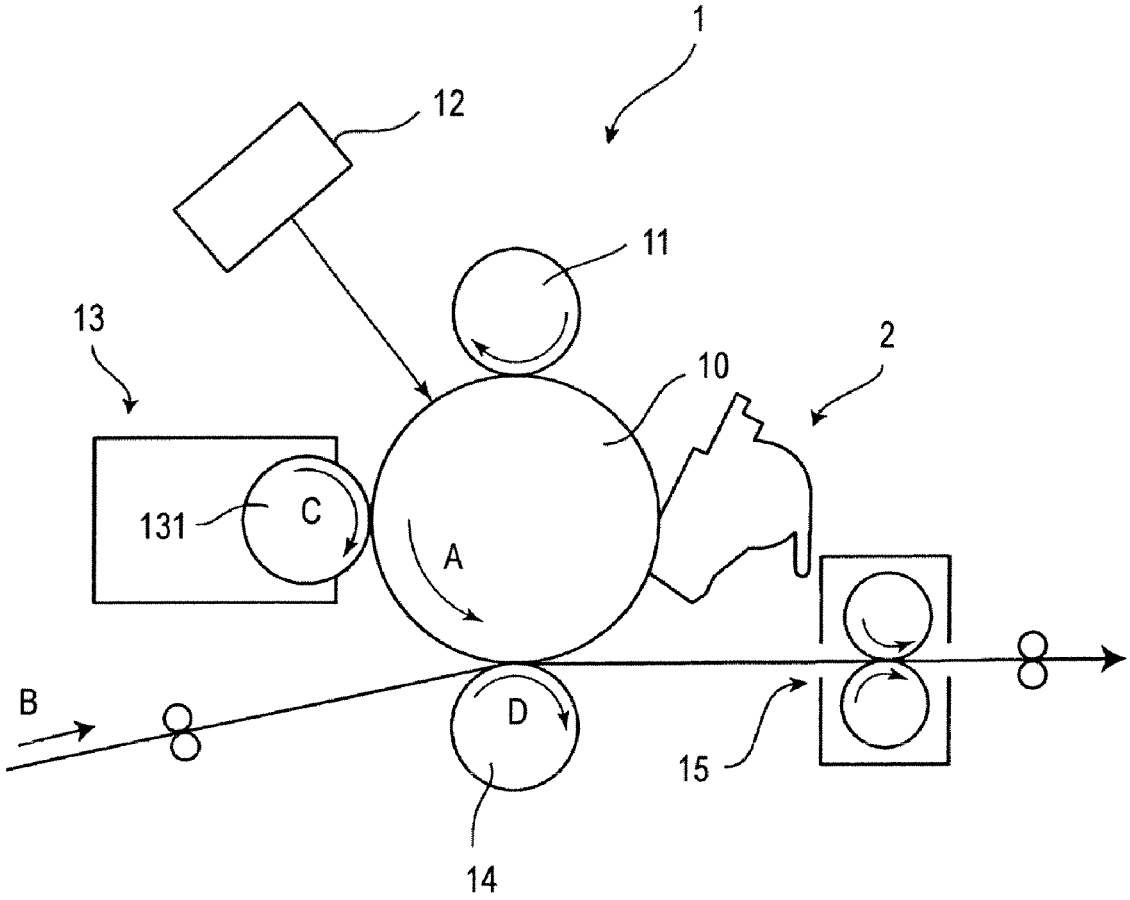
FIG. 1 is a schematic sectional view of an image forming apparatus.

FIG. 1 is a schematic sectional view of an image forming apparatus.

In an image forming apparatus 1 shown in FIG. 1, onto the surface of a photosensitive drum 10 rotating in the direction of arrow A, which is an example of a toner holder, supplied with a charge by a charging roll 11, exposure light produced by an exposure device 12 formed on the basis of image data transmitted from the outside is put, thereby to form an electrostatic latent image. The electrostatic latent image thus formed is developed with the toner accommodated in a developing device 13 having a developing roll 131 rotating in the direction of arrow C. The developed image obtained by this development is pulled out from a sheet cassette (not shown), transferred on to a recording sheet transported in the direction of arrow B by a transfer roll 14 rotating in the direction of arrow D and fixed by a fixing device 15, thereby forming an image on the recording sheet. It should be noted that this image forming apparatus 1 is a monochromatic image dedicated machine.

In FIG. 1, there is shown a cleaning device 2 for removing the residue left on the surface of the photosensitive drum 10 which is in contact with an area of the photosensitive drum 10 where the developed image has been transferred on the recording sheet.

Figure 2:
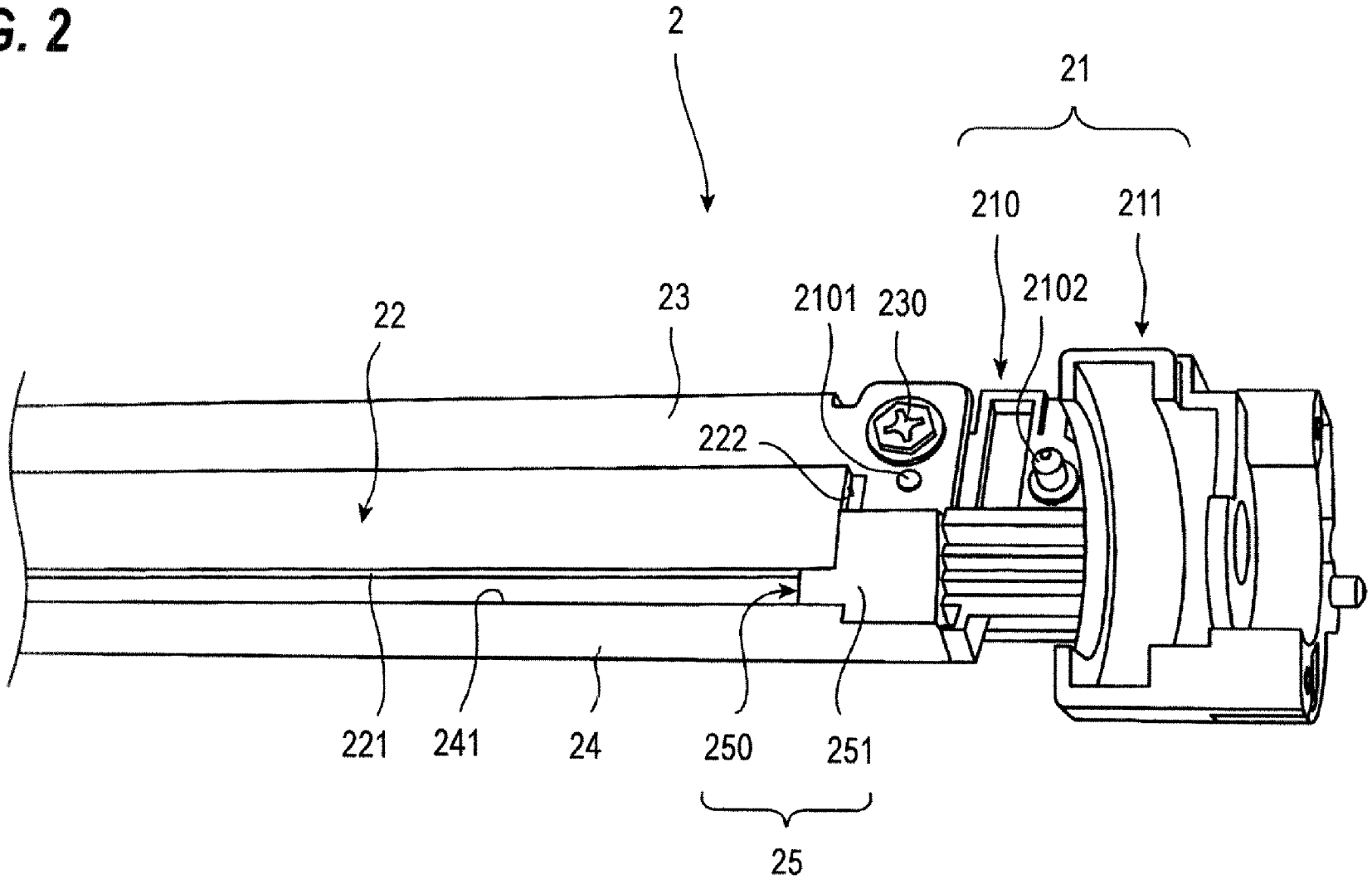
FIG. 2 is a partial appearance view of the cleaning device.

FIG. 2 is a partial appearance view of the cleaning device.

In FIG. 2, illustrated is the one end of the cleaning device 2 when the cleaning device 2 shown in FIG. 1 is seen from the developing device 13 side through the photosensitive drum 10. The cleaning device 2 is laterally symmetrical so that only this end will be explained below.

The cleaning device 2 includes a cleaning frame 21 which is an example of a box in this invention; a blade 22 which is an example of a toner removing member in this invention; a blade supporting plate 23 supporting the blade 22 which is an example of a supporting member; a film member 24 which is an example of a sealing member; and a felt member 25 which is an example of a sliding member.

The blade 22 is made of rubber to remove the residue left on the surface of the photosensitive drum 10 with which the tip 221 of the blade 22 is brought into contact.

The blade supporting plate 23 is a metallic plate supporting the blade 22 and secured to the cleaning frame 21 by an anchoring screw 230.

The cleaning frame (housing) 21 has a concave space 210*a* for accommodating the residue removed from the surface of the photosensitive drum 10, and includes a body 210 screwed with the blade supporting plate 23 supporting the blade 22 at an area of the edge 210*b* of the concave space 210*a* (see FIG. 4) and a holding portion 211 for rotatably holding both ends of the photosensitive drum 10. The body 210 is provided with a boss 2101 used to position the blade supporting plate 23 and also a boss 2102 used to arrange the cleaning frame 21 at a predetermined position of the image forming apparatus 1. Further, although described later in detail, screwing the blade supporting plate 23 supporting the blade 22 to the cleaning frame 21 is done while involving a thermoplastic elastomer 20 (see FIG. 6) which is a sealing member applied to an edge 210*b* of the concave space 210*a* of the cleaning frame 21.

Figure 7:
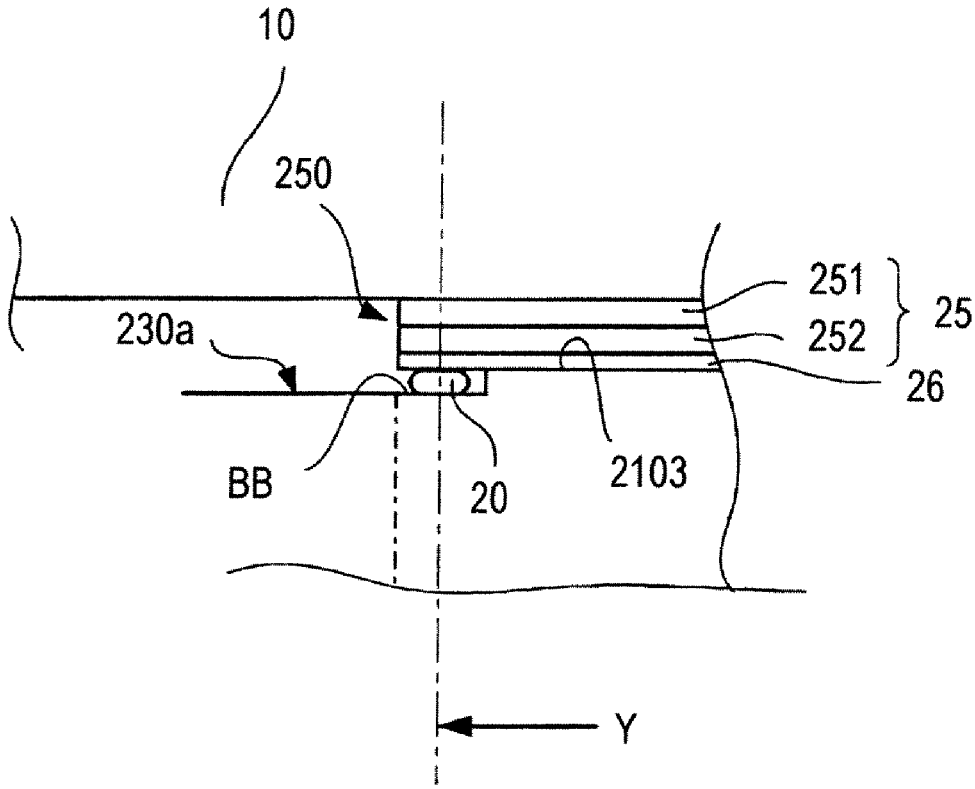
FIG. 7 is a view showing the manner that a photosensitive drum is assembled with a holding portion of the cleaning frame.

The felt member 25 is composed of a surface, i.e. a felt layer 251 and its underlying layer i.e. an elastic layer 252 (see FIG. 7). The elastic layer 252 is slightly crushed in a state where the photosensitive drum 10 is held by the holding portion 211 of the cleaning frame 21. Thus, the felt layer 251 is brought in closely contact with the photosensitive drum 10 so that leakage of the residue can be prevented.

The felt member 25 has also a protrusion 250 protruding toward the edge 210*b* of the concave space 210*a*. In FIG. 2, shown is the manner that the side face of the protrusion 250 and the face on the blade side of the portion other than the protrusion 250 of the felt member 25 are conformed to the corner of the blade 22. Now, although a contact area with the photosensitive drum 10 is formed of the felt layer 251, it may be formed of the material other than the felt material, having a small friction coefficient enough to not obstruct the rotation of the photosensitive drum 10 when brought into contact with the photosensitive drum 10.

The film member 24 is formed of a polyurethane sheet. Its tip 241 is brought into contact with the photosensitive drum 10 in a state where it is held in the holding portion 211 of the cleaning frame 21 so that leakage of the residue can be prevented.

Figure 3:
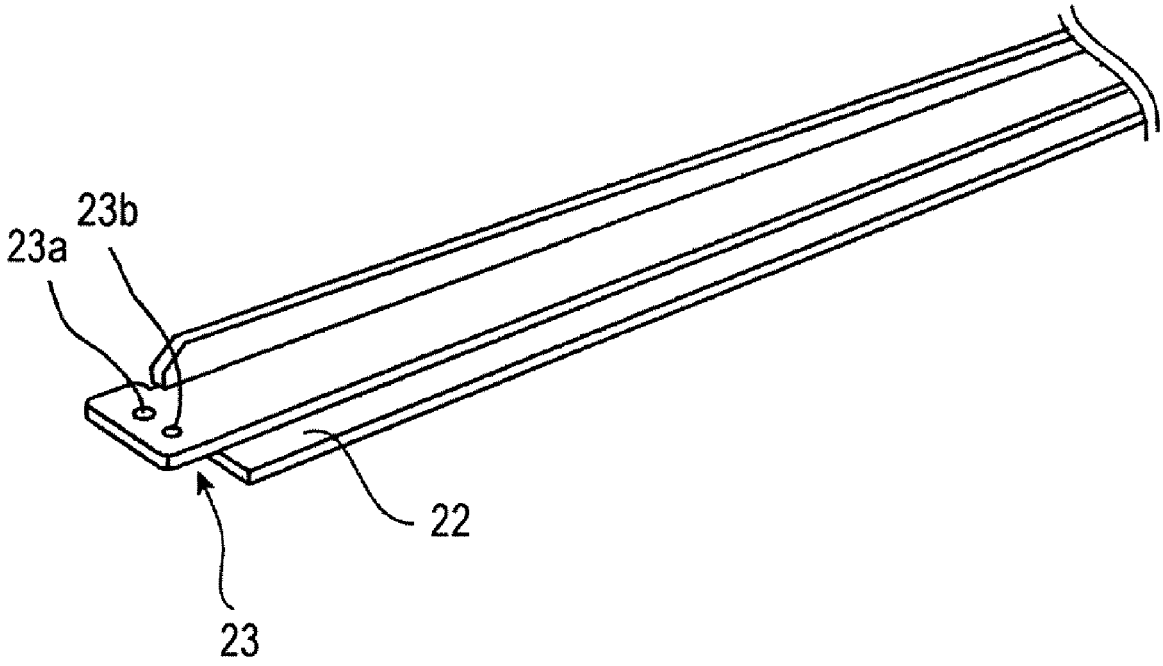
FIG. 3 is a view of the blade supporting plate holding the blade.

FIG. 3 is a view of the blade supporting plate In the state where it supports the blade.

In FIG. 3, shown is the blade supporting plate 23 holding the blade 22 before it is screwed to the cleaning frame 21 of the cleaning device 2, with its face in contact with the cleaning frame 21 being directed upward. Also in FIG. 3, shown is the manner providing a slot 23*a* through which the anchoring screw 230 shown in FIG. 2 passes and a slot 23*b* through which the boss 2101 of the cleaning frame 21 passes.

Figure 4:
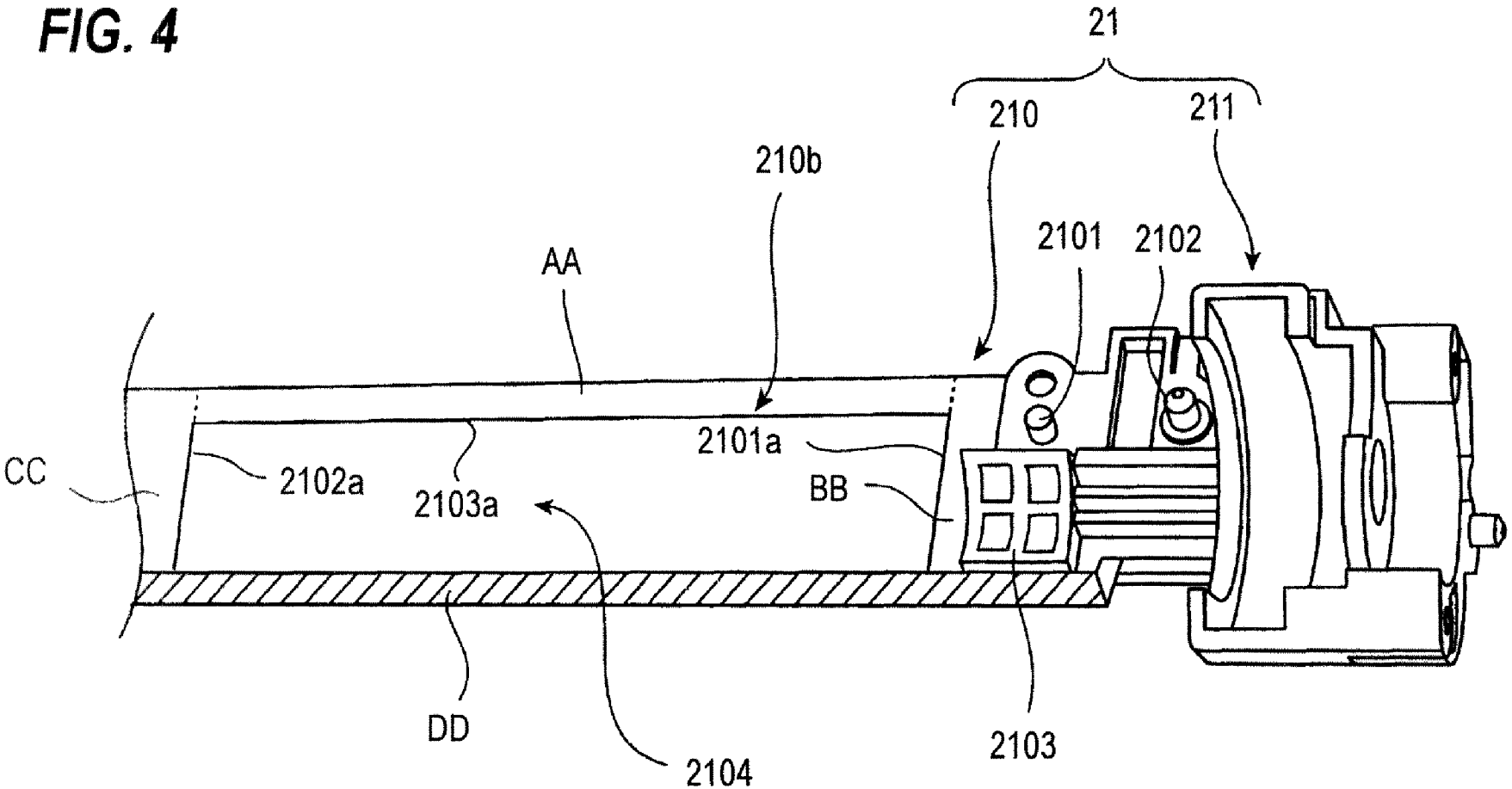
FIG. 4 is a view showing a cleaning frame.

FIG. 4 is a view of the cleaning frame.

In FIG. 4, shown is the cleaning frame 21 in a state before the blade supporting plate 23, felt member 25 and film member 24 are attached to the body 210. Now, the edge 210*b* of the concave space 210*a* accommodating the residue is exposed. A peripheral edge segment AA, a peripheral edge segment BB and a peripheral edge segment CC, which encircle the edge 210*b* of the concave space 210*a*, exist in a first plane constituted by an upper surface of the body 210 while a peripheral edge segment DD exists In a second plane crossing the first plane.

Now, the peripheral edge segment BB and peripheral edge segment CC refers to not only a region along the area constituting edges 2101*a*, 2102*a* forming the concave space 210*a* in an axial direction of the photosensitive drum 10 nearly orthogonal to the moving direction of the photosensitive drum 10, but also, as in this embodiment, a region between the area constituting the edges 2101*a*, 2102*a* and the ends of the blade 22 in the axial direction of the photosensitive drum 10. The peripheral edge segment AA refers to not only a region along the area constituting an edge 2103*a* forming the edge 210*b* of the concave space 210*a* on the side where the blade supporting plate 23 is arranged, but also as in this embodiment, a region where the blade supporting plate 23 and the cleaning frame 21 are opposite to each other. Further, the peripheral edge segment DD refers to not only a region along the area constituting the edge forming the edge 210*b* of the concave space 210*a* on the side where the film member 24 is arranged, but also, as in this embodiment, a region between the area forming this edge and the film member 24.

Now referring to FIGS. 4 to 7, a brief explanation will be given of a method for assembling the cleaning device 2.

Figure 5:
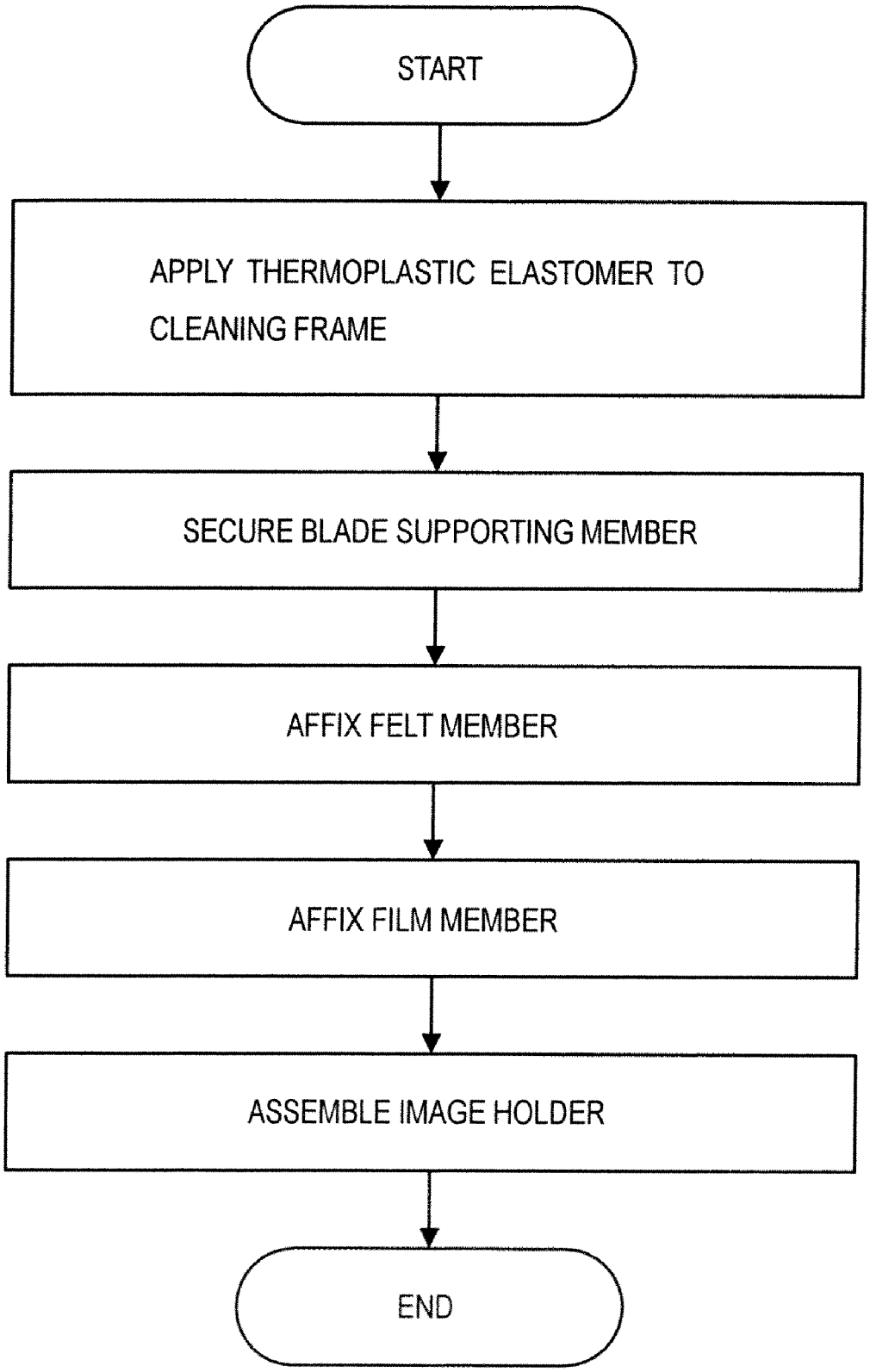
FIG. 5 is a flowchart showing the flow of the method of assembling the cleaning device.

FIG. 5 is a flowchart showing the flow of the method of assembling the cleaning device.

As shown in FIG. 5, in step S1, the thermoplastic elastomer 20 applied in a liquid state and solidified to block the gaps among the members is applied to the peripheral edge segment AA, peripheral edge segment BB, and peripheral edge segment CC constituting the peripheral edge of the edge 210*b* of the concave space 210*a* of the cleaning frame 21. In step S2, the blade supporting plate 23 supporting the blade 22 is screwed to be secured the cleaning frame 21. At this stage, the respective segments of the peripheral edge segment AA, peripheral edge segment BB, and peripheral edge segment CC of the peripheral edge of the edge 210*b* of the concave space 210*a* are covered with the blade 22 and blade supporting plate 23 supporting the blade 22 so that the edge 210*b* of the concave space 210*a* becomes the state narrowed as compared with the state shown in FIG. 4.

Figure 6:
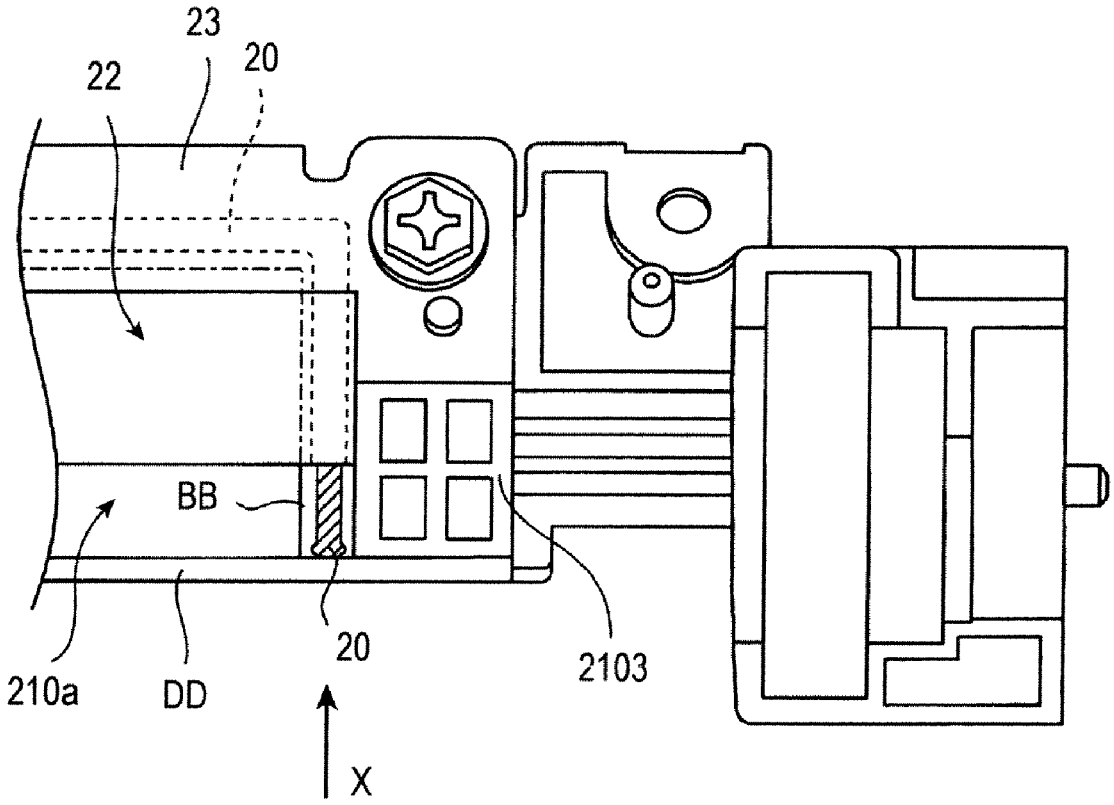
FIG. 6 is a view showing the state where a blade supporting plate is secured to the cleaning frame.

FIG. 6 is a view showing the state where a blade supporting plate is secured to a cleaning frame. In FIG. 6, the portion covered with the members and not seen of the peripheral edge of the edge 210*b* of the concave space 210*a* is illustrated in a one-dot chain line and the portion covered with the members and not seen of the thermoplastic elastomer 20 applied on the peripheral edge segments is illustrated in a dotted line.

FIG. 6 shows the state where the portion covered with the blade 22 and the blade supporting plate 23 supporting the blade 22 of the thermoplastic elastomer 20 applied to the peripheral edge segments AA, BB and CC constituting the peripheral edge of the edge 210*b* of the concave space 210*a* is compressed to be enlarged by securing the blade supporting plate 23 supporting the blade 22 to the cleaning frame 21. Returning to FIG. 5, the explanation will be continued.

Next, in step S3, the felt member 25 is affixed to a felt affixing plane 2103 (see FIG. 4). In step S4, the film member 24 is affixed to the peripheral edge segment DD. Now, the end of the film member 24 is affixed to the peripheral edge segment DD by a double-faced tape not shown. In step S5, the photosensitive drum 10 is assembled with the holding portion 211 of the cleaning frame 21.

FIG. 7 is a view showing the state where the photosensitive drum is assembled with the holding portion of the cleaning frame. In order to avoid complication, in the film member 24 is not shown in FIG. 7.

In FIG. 7, shown is the case when the peripheral edge segment BB is seen In the direction of arrow X in FIG. 6. Now, illustrated is the manner where the felt member 25 is affixed to the felt affixing plane 2103 by the double-faced tape 26. As described above, when the photosensitive drum 10 is assembled with the holding portion 211 of the cleaning frame 21, the elastic layer 252 of the felt member 25 is slightly compressed so that the felt layer 251 is brought into closely contact with the photosensitive drum 10. At this time, the thermoplastic elastomer 20 on the film member 24 side in the peripheral edge segment BB is also compressed between the double-sided face tape 26 at the projection 250 of the felt member 25 explained in FIG. 2 and the peripheral edge segment BB. In this way, both ends of the blade 22 whose contact pressure for the surface of the photosensitive drum 10 is likely to be lowered as compared with the other portion are supported by repulsion force due to compression of the thermoplastic elastomer 20 having elasticity so that positional changes in the contact pressure of the blade 22 for the surface of the photosensitive drum 10 are prevented, thereby suppressing deflective abrasion of the surface of the photosensitive drum 10. Thus, the method for assembling the cleaning device 2 has been schematically described. This cleaning device 2 is a first embodiment common to the first, second and third toner removing devices according to this invention.

In the following, a detailed explanation will be given of sealing, using the thermoplastic elastomer 20, the gap between the peripheral edge segments BB, CC, and the blade 22, blade supporting plate 23 and felt member 25 in the cleaning device 2. The liquid material applying method described below is a first embodiment common to the first, second and third liquid applying methods according to this invention.

FIG. 8 is a sectional view of the cleaning device assembled with the photosensitive drum.

Figure 8A:
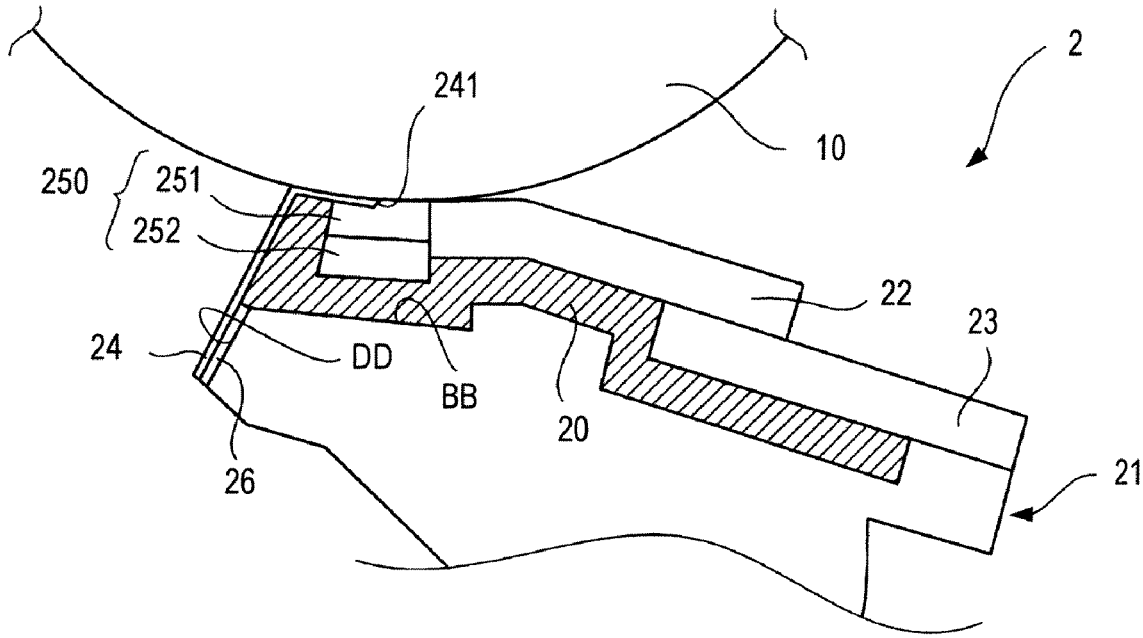
FIGS. 8A and 8B are sectional views of the cleaning device assembled with the photosensitive drum.

FIG. 8A shows the manner when the section indicated by one-dot chain line in FIG. 7 is seen from the direction of arrow Y. As seen, the tip 241 of the film member 24 affixed to the peripheral edge segment DD by the double-sided tape 26 is involved into the felt member 25 side. Thus, leakage of the residue from the film member 24 side is suppressed.

Further, as seen from FIG. 8A, the gap between the cleaning frame 21 and the film member 24, felt member 25, blade 22 and blade supporting plate 23 is made uniform.

Figure 8B:
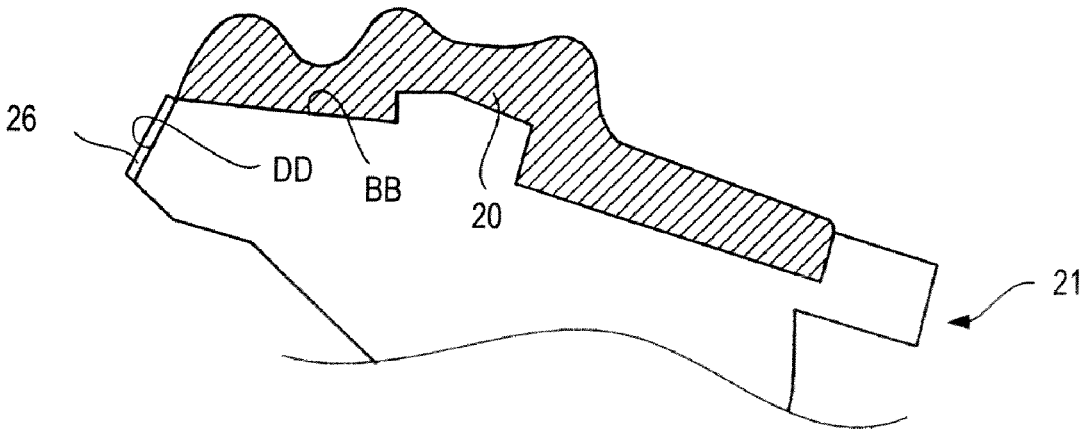

FIG. 8B shows the manner when the section of the cleaning frame 21 applied with the thermoplastic elastomer 20 in the peripheral edges A, B and C before the blade supporting plate 23 and others are assembled is seen from the direction of arrow Y in FIG. 7. As seen from FIG. 8B, the applied quantity of the thermoplastic elastomer 20 is larger in the area corresponding to the step portion between the blade 22 and the blade supporting plate 23 and the area corresponding to the portion sandwiched by the film member 24 and felt member 25, where the thermoplastic elastomer 20 is resistant to spread, than at other areas.

In the liquid material applying method according to this embodiment, the applied quantity of the thermoplastic elastomer 20 to the cleaning frame 21 of the cleaning device 2 with a uniform gap between the cleaning frame 21 and the members assembled with the cleaning frame 21 is made larger in the areas where the unnecessary things are more likely to leak than the other areas, among the respective areas of the cleaning frame 21, i.e. the area corresponding to the step portion between the blade 22 and the blade supporting plate 23 and the area corresponding to the portion sandwiched by the film member 24 and felt member 25, where the thermoplastic elastomer 20 is resistant to spread, than at the other areas. Under this condition, the respective members are secured to the cleaning frame 21 from above the applied thermoplastic elastomer 20 while compressing the applied thermoplastic elastomer 20 in the order of step S2 et seq. in FIG. 5. Thus, the thermoplastic elastomer 20 can be surely filled in the areas where the thermoplastic elastomer 20 is resistant to spread so that the capability of blocking the gap can be improved. Accordingly, in accordance with the liquid material applying method in this embodiment, the capability of blocking the gap can be improved.

Next, an explanation will be given of a second embodiment common to the first, second and third liquid applying methods according to this invention.

The liquid material applying method according to this embodiment is different from the liquid material applying method according to the first embodiment as follows. The liquid material applying method according to first embodiment is directed to the cleaning device with the uniform gap between the cleaning frame 21 and the members assembled therewith, and gives the areas where the thermoplastic elastomer 20 is resistant to spread the applied quantity of the thermoplastic elastomer larger than the other areas. On the other hand, the liquid material applying method according to this embodiment is directed to the cleaning device with the gap between the cleaning frame 21 and the members assembled therewith, narrower in the area where the thermoplastic elastomer 20 is resistant to spread than the other areas, and applies the thermoplastic elastomer 20 uniformly to all the areas.

FIG. 9 is a sectional view of the cleaning device assembled with the photosensitive drum 10. In FIG. 9, like reference symbols refer to like functional members in FIG. 8. The cleaning device 2 shown in FIG. 9 is a second embodiment common to the first, second and third toner removing devices according to this invention.

Figure 9A:
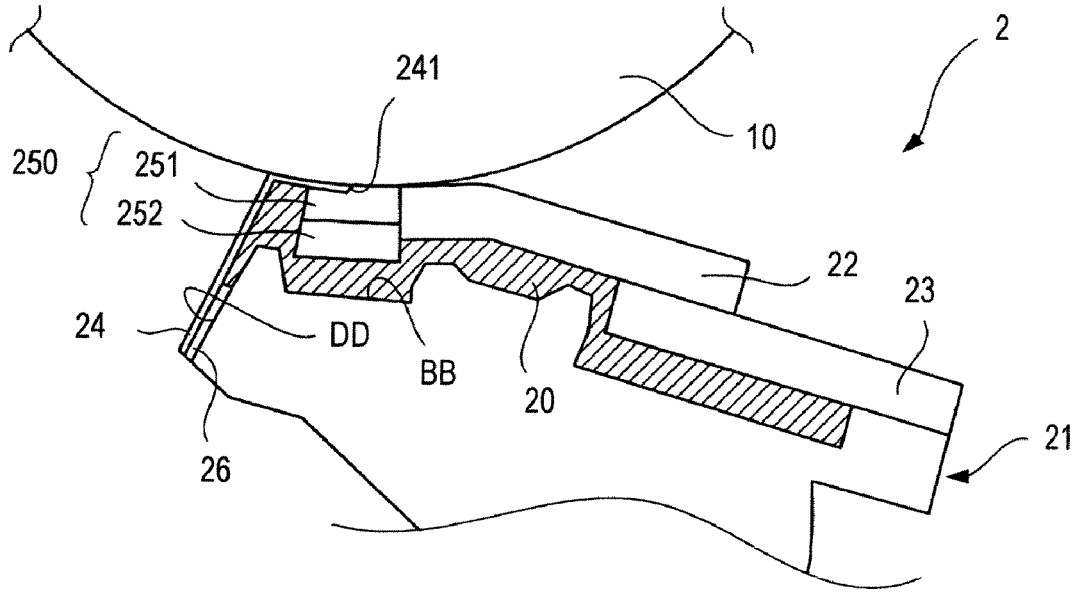
FIGS. 9A and 9B are sectional view of the cleaning device assembled with the photosensitive drum.

As seen from FIG. 9A, the gap between the cleaning frame 21 and the film member 24, felt member 25, blade 22 and blade supporting plate 23, which constitute the cleaning device 2 is narrower in the area where the residue is likely to leak, i.e. where the thermoplastic elastomer 20 is resistant to spread, than at other areas.

Figure 9B:
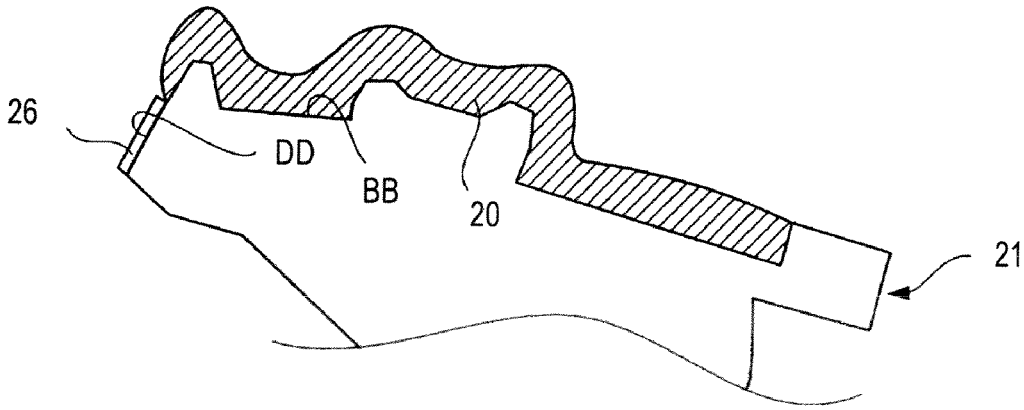

FIG. 9B shows a view of the cleaning frame 21 applied with the thermoplastic elastomer 20 in the peripheral edges AA, BB and CC before the blade supporting plate 23 and others are assembled when the section indicated by the one-dot chain line in FIG. 7 is seen from the direction of arrow Y. As seen from FIG. 9B, the applied quantity of the thermoplastic elastomer 20 is made uniform irrespectively of whether or not the area at issue is the area where the thermoplastic elastomer 20 is resistant to spread.

In the liquid material applying method according to this embodiment, the applied quantity of the thermoplastic elastomer 20 to the cleaning frame 21 of the cleaning device 2 with the gap between the cleaning frame 21 and the members assembled with the cleaning frame 21 is being narrower in the areas where the thermoplastic elastomer 20 is resistant to spread than at the other areas is made uniform irrespectively of whether or not the area at issue is the where the residue is more likely to leak than the other areas, among the respective areas of the cleaning frame 21. Under this condition, the respective members are secured to the cleaning frame 21 from above the applied thermoplastic elastomer 20 while crushing the applied thermoplastic elastomer 20 in the order of step S2 et seq. in FIG. 5. In this way also, the thermoplastic elastomer 20 can be surely filled in the area where the thermoplastic elastomer 20 is resistant to spread so that the blocking capability of the gap can be improved. Accordingly, in accordance with the liquid material applying method in this embodiment, the blocking capability can be improved.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A toner removing device for cleaning a toner image carrier that has a surface moving in a predetermined direction and holding a toner image, the toner removing device comprising:

a toner removing member that is in contact with the surface of the toner image carrier along a crossing direction that crosses a moving direction of the surface of the toner image carrier, the toner removing member removing a toner that remains on the surface of the toner image carrier;

a supporting member that supports the toner removing member; and a housing that includes a toner accommodating portion that accommodates the toner removed by the toner removing member, and is mounted with the toner removing member and the supporting member by a solidified material that is a liquid material when applied to the housing, wherein the liquid material is applied to a first peripheral edge segment located at an end portion of the toner accommodating portion in the longitudinal direction of the toner removing member, the housing includes a second peripheral edge segment, perpendicular to the first peripheral edge segment, the first peripheral edge segment includes a first flat portion near the second peripheral edge segment, a second flat portion remote from the second peripheral edge segment, and a protrusion between the first flat portion and the second flat portion, and an applied amount of the liquid material on a portion of the protrusion near the second flat portion is greater than an applied amount of the liquid material on the second flat portion.

2. A toner removing device for cleaning a toner image carrier that has a surface moving in a predetermined direction and holding a toner image, the toner removing device comprising:

a toner removing member that is in contact with the surface of the toner image carrier along a crossing direction that crosses a moving direction of the surface of the toner image carrier, the toner removing member removing a toner that remains on the surface of the toner image carrier;

a supporting member that supports the toner removing member; and a housing that includes a toner accommodating portion that accommodates the toner removed by the toner removing member, and is mounted with the toner removing member and the supporting member by a solidified material that is a liquid material when applied to the housing, wherein the distance between the housing and a step portion between the toner removing member and the supporting member is narrower than a gap between a side of the supporting member opposite the toner removing member and the housing, and the liquid material is applied with a uniform amount along a peripheral edge segment located at an end portion of the toner accommodating portion in the longitudinal direction of the toner removing member.

3. A toner removing device for removing toner from a toner image carrier that has a surface moving in a predetermined direction and holding a toner image, the toner removing device comprising:

a toner removing member that is in contact with the surface of the toner image carrier along a crossing direction that crosses a moving direction of the surface of the toner image carrier, the toner removing member removing a toner that remains on the surface of the toner image carrier;

a supporting member that supports the toner removing member;

a sliding member that is arranged at a location being an upstream side of the toner removing member in the moving direction of the surface of the toner image carrier, and is in contact with the surface of the toner image carrier;

a housing that includes a toner accommodating portion that accommodates the toner removed by the toner removing member, the housing being attached to the toner removing member and the supporting member through a solidified material that is a liquid material when applied to the housing; and a sealing member that is arranged at a location being an upstream side of the sliding member in the moving direction of the surface of the toner carrier, and seals a space between the toner image carrier and the housing, wherein the liquid material is applied to a first peripheral edge segment located at an end portion of the toner accommodating portion in the longitudinal direction of the toner removing member, the housing includes a second peripheral edge segment, perpendicular to the first peripheral edge segment, the first peripheral edge segment includes a first flat portion near the second peripheral edge segment, a second flat portion remote from the second peripheral edge segment, and a protrusion between the first flat portion and the second flat portion, and an applied amount of the liquid material on a portion of the first flat portion near the second peripheral edge segment is greater than an applied amount of the liquid material on the second flat portion.

4. A toner removing device for removing toner from a toner image carrier that has a surface moving in a predetermined direction and holding a toner image, the toner removing device comprising:

a toner removing member that is in contact with the surface of the toner image carrier along a crossing direction that crosses a moving direction of the surface of the toner image carrier, the toner removing member removing a toner that remains on the surface of the toner image carrier;

a supporting member that supports the toner removing member;

a sliding member that is arranged at a location being an upstream side of the toner removing member in the moving direction of the surface of the toner image carrier, and is in contact with the surface of the toner image carrier;

a housing that includes a toner accommodating portion that accommodates the toner removed by the toner removing member, the housing being attached to the toner removing member and the supporting member through a solidified material that is a liquid material when applied to the housing; and a sealing member that is arranged at a location being an upstream side of the sliding member in the moving direction of the surface of the toner carrier, and seals a space between the toner image carrier and the housing, wherein the distance between the housing and the boundary between the sliding member and the sealing member is narrower than a gap between a side of the supporting member opposite the toner removing member and the housing, and the liquid material is applied with a uniform amount along a peripheral edge segment located at an end portion of the toner accommodating portion in the longitudinal direction of the toner removing member.

5. A toner removing device for removing toner from a toner image carrier that has a surface moving in a predetermined direction and holding a toner, the toner removing device comprising:

a toner removing member that is in contact with the surface of the toner image carrier along a crossing direction that crosses a moving direction of the surface of the toner image carrier, the toner removing member removing a toner that remains on the surface of the toner image carrier;

a supporting member that supports the toner removing member;

a sliding member that is arranged at a location being an upstream side of the toner removing member in the moving direction of the surface of the toner image carrier, and is in contact with the surface of the toner image carrier; and a housing that includes a toner accommodating portion that accommodates the toner removed by the toner removing member, the housing being attached to the toner removing member and the supporting member through a solidified material that is a liquid material when applied to the housing, wherein the liquid material is applied to a first peripheral edge segment located at an end portion of the toner accommodating portion in the longitudinal direction of the toner removing member, the housing includes a second peripheral edge segment, perpendicular to the first peripheral edge segment, the first peripheral edge segment includes a first flat portion near the second peripheral edge segment, a second flat portion remote from the second peripheral edge segment, and a protrusion between the first flat portion and the second flat portion, and an applied amount of the liquid material on a portion of the protrusion near the first flat portion is greater than an applied amount of the liquid material on the second flat portion.

6. A toner removing device for removing toner from a toner image carrier that has a surface moving in a predetermined direction and holding a toner image, the toner removing device comprising:

a toner removing member that is in contact with the surface of the toner image carrier along a crossing direction that crosses a moving direction of the surface of the toner image carrier, the toner removing member removing a toner that remains on the surface of the toner image carrier;

a supporting member that supports the toner removing member;

a sliding member that is arranged at a location being an upstream side of the toner removing member in the moving direction of the surface of the toner image carrier, and is in contact with the surface of the toner image carrier; and a housing that includes a toner accommodating portion that accommodates the toner removed by the toner removing member, the housing being attached to the toner removing member and the supporting member through a solidified material that is a liquid material when applied to the housing, wherein the distance between the housing and the boundary between the toner removing member and the sliding member is narrower than a gap between a side of the supporting member opposite the toner removing member and the housing, and the liquid material is applied with a uniformed amount along a peripheral edge segment located at an end portion of the toner accommodating portion in the longitudinal direction of the toner removing member.

* * * * *